US005134358A

United States Patent [19]

Agiman

[11] Patent Number: 5,134,358

[45] Date of Patent: Jul. 28, 1992

[54] IMPROVED CURRENT MIRROR FOR SENSING CURRENT

[75] Inventor: Dan Agiman, West Warwick, R.I.

[73] Assignee: Texas Instruments Incorporated, Dallas, Tex.

[21] Appl. No.: 648,255

[22] Filed: Jan. 31, 1991

[51] Int. Cl.[5] ..... G05F 3/16

[52] U.S. Cl. ..... 323/316; 323/315

[58] Field of Search ..... 323/315, 316

[56] References Cited

U.S. PATENT DOCUMENTS

| | | | |
|---|---|---|---|
| 3,629,692 | 12/1971 | Goyer | 323/315 |
| 3,925,718 | 12/1975 | Wittlinger | 323/315 |
| 3,930,172 | 12/1975 | Dobkin | 323/315 |
| 4,319,181 | 3/1982 | Wrathall | 323/315 |
| 4,338,646 | 7/1982 | Davis et al. | 323/315 |
| 4,553,084 | 11/1985 | Wrathall | 323/314 |
| 4,820,968 | 4/1989 | Wrathall | 323/316 |
| 4,827,207 | 5/1989 | Chieli | 323/315 |
| 4,882,533 | 11/1989 | Kelley | 323/315 |
| 5,008,586 | 4/1991 | Miyazaki et al. | 323/315 |

*Primary Examiner*—Steven L. Stephan
*Assistant Examiner*—Jeffrey Sterrett
*Attorney, Agent, or Firm*—B. Peter Barndt; Richard L. Donaldson

[57] ABSTRACT

A technique is described for improving the sampled current accuracy in current mirror circuits such as are often used to monitor the current output to a load. A reference voltage is established to feedback the load voltage conditions at the output to the current reference circuitry, thereby greatly reducing the error in the reference current over that which is produced by prior art circuits. The technique is shown aas applied to a current limiting circuit for driving an output load. An alternative embodiment is also disclosed.

2 Claims, 4 Drawing Sheets

IMPROVED CURRENT MIRROR FOR SENSING CURRENT

TECHNICAL FIELD OF THE INVENTION

This invention pertains generally to circuits used in applications where it is desirable to monitor the current available to a load at an output. A specific embodiment is disclosed where the sampled current is used to regulate the current at an output.

BACKGROUND OF THE INVENTION

A typical problem of electronic circuit design occurs in the design of an output driver stage when there is a need to regulate the current supplied to a load. This current limiting stage is necessary to protect the driving device from excessive currents due to a short-circuited condition at the output or other heavy load conditions that could lead to device overload failure.

Prior art current limiting circuits sample the current supplied to an output and then use the sampled current to regulate the current available to the output load. A common approach to the current sampling involves the use of a current mirror scheme. A typical prior art current mirror is shown in FIG. 1.

Transistor 12 in FIG. 1 is the output driving transistor. The current available at the output is primarily a function of the voltage at the base-emitter junction, Vbe12, and the physical characteristics of the device. The current flowing to the load at the output terminal is the collector current of 12, which may be expressed as:

$$Ic12 = Is(1 + Vce/Va)\exp(Vbe/Vt)$$

The well known relationship between collector current, base-emitter voltage and collector-emitter voltage for a bipolar transistor is shown in FIG. 2. Note that the collector current depends primarily upon the Vbe voltage. In cases where the voltage Vce is low, the term Vce/Va may be quite small and almost ideal behavior occurs where the collector current is independent of the collector-emitter voltage. However, as Vce grows to large values the collector current begins to increase, independent of the voltage Vbe. This effect, the Early voltage effect, appears as increased gain and is often referred to as "beta modulation".

In the current mirror of prior art, as in FIG. 1, the transistor 18 is used to generate a reference current. It can be readily seen that if the two transistors are identical, then Is12=Is18, and as connected in FIG. 1 the base-emitter voltages Vbe12 and Vbe18 are equal as well. In this case Ic12=Ic18 so long as Vce12=Vce18.

However, the sampled current produced by the prior art current mirror may not reflect the output current accurately due to the conditions at the output. For example, if the output transistor saturates, the output current will fall, while the sampled current remains high, which may cause premature current limiting. Conversely, in a short-circuited situation the output current may increase rapidly while the sampled current remains stable, thus limiting may not occur as desired. As will be discussed herein, this is of particular importance in applications where low voltages do indeed occur at the output terminal of a driving circuit.

SUMMARY OF THE INVENTION

An object of the present invention is an improved method and apparatus for monitoring the output current to a circuit load. More specifically, an object of this invention is a method and apparatus for providing an output current to a load and generating a very accurate reference current which maintains its relationship to the output current irrespective of variations in voltage at the output.

DESCRIPTION OF THE PREFERRED EMBODIMENT

Figure 1:
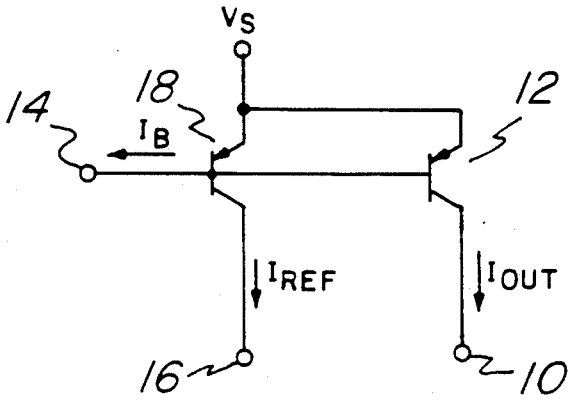
PRIOR ART Fig. 1
FIG. 1 illustrates a typical prior art current mirror circuit.

FIG. 1 illustrates a conventional prior art current mirror. Output node 10 is coupled to the collector of transistor 12. The base of transistor 12 is coupled to transistor 18 and further to input node 14. The emitters of transistors 12 and 18 are coupled together and further coupled to reference voltage Vs. The reference current node 16 is coupled to the collector of 18.

Figure 2:
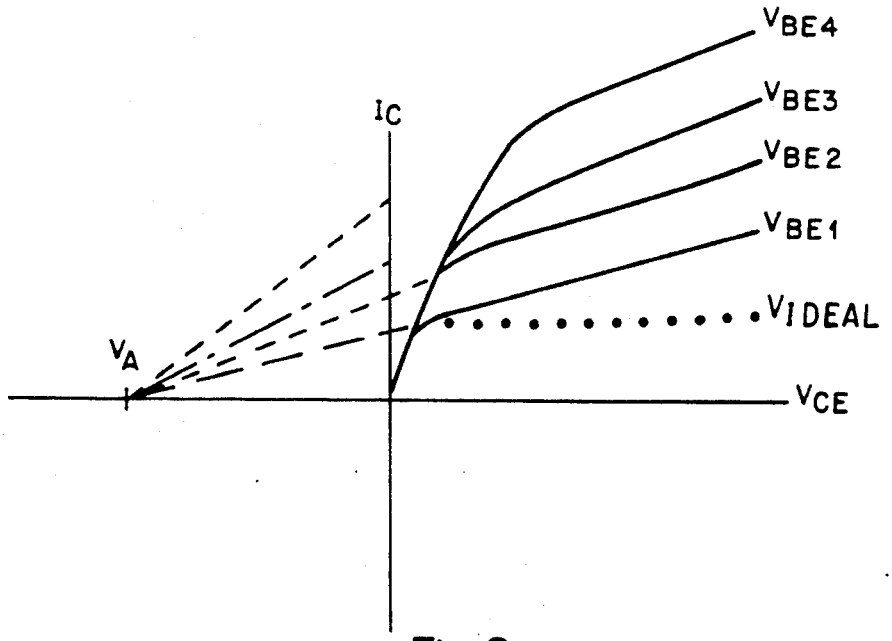
FIG. 2 illustrates a typical collector current curve for a transistor in the forward active region.

FIG. 2 is a current vs. voltage (I-V) curve trace of a typical collector current vs. collector-emitter voltage for a variety of base-emitter voltages for a bipolar transistor. The dotted line indicates the ideal, in which collector current is independent of collector-emitter voltage.

Figure 3:
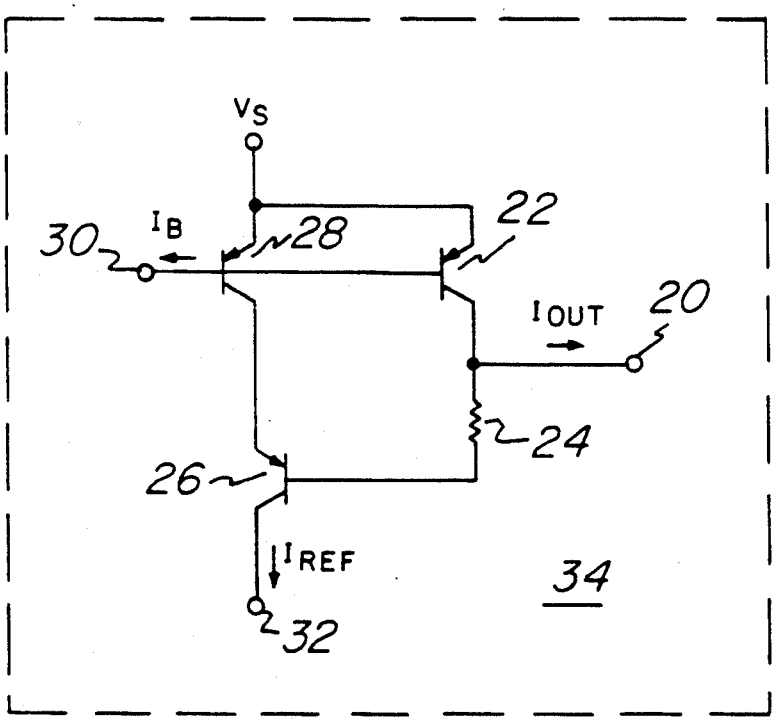
FIG. 3 illustrates the improved current mirror according to the present invention.

FIG. 3 illustrates the improved current mirror of the invention, 34. Output node 20 is coupled to the collector of transistor 22 and is further coupled to the resistor 24. The base of transistor 26 is coupled to output node 20 through resistor 24. The emitter of transistor 26 is coupled to the collector of 28 and the collector of 26 is coupled to the reference current output node 32. The base of transistor 28 is coupled to the base of transistor 22 and to the current node 30. The emitter of transistor 28 is coupled to the emitter of transistor 22 and to the voltage supply Vs.

In operation, the output transistor 22 supplies current to the output load at output node 20. Transistor 28 reflects the current as in the prior art circuit so that the current at the emitter of 22 is proportional to the current flowing in the emitter of 28. Transistor 26 in the figure couples the voltage at the output node 20 to the collector of 28. The voltage across the collector-emitter of 22 is now directly related to the voltage across the collector-emitter of transistor 28. The mathematical relationship is:

$$Vce22 = Vce28 + Vbe26.$$

Since Vbe26 is fairly small, the collector-emitter voltages of the output transistor 22 and the sampling transistor 28 are virtually equal. As discussed above, so long as the collector-emitter voltages of 22 and 28 are equal, the collector currents will be equal as well.

The current equations of interest for the improved current mirror are:

$$Ic22 = Is(1 + Vce22/Va)*\exp Vbe22/Vt$$

$$Ic28 = Is(1 + Vce28/Va)*\exp Vbe28/Vt$$

Substituting the expression for Vce22 above, and simplifying the expression containing Va gives:

$$Ic22 = Is(Va + Vce28 + Vbe26)/Va*\exp Vbe22/Vt$$

Since Vbe22 = Vbe28, the ration of the two currents is:

$$Ic22/Ic28 = (Va + Vce28 + Vbe26)/(Va + Vce28).$$

As Va>>Vbe26, this ratio approximates unity which clearly shows the advantage of reflecting the output voltage back to the transistor 28 in maintaining the accuracy of the reference current Ic28. This current is the current flowing through 26 and out of its emitter and is therefore extremely close to the current flowing out of the output node 20 over a wide range of conditions.

Figure 4:
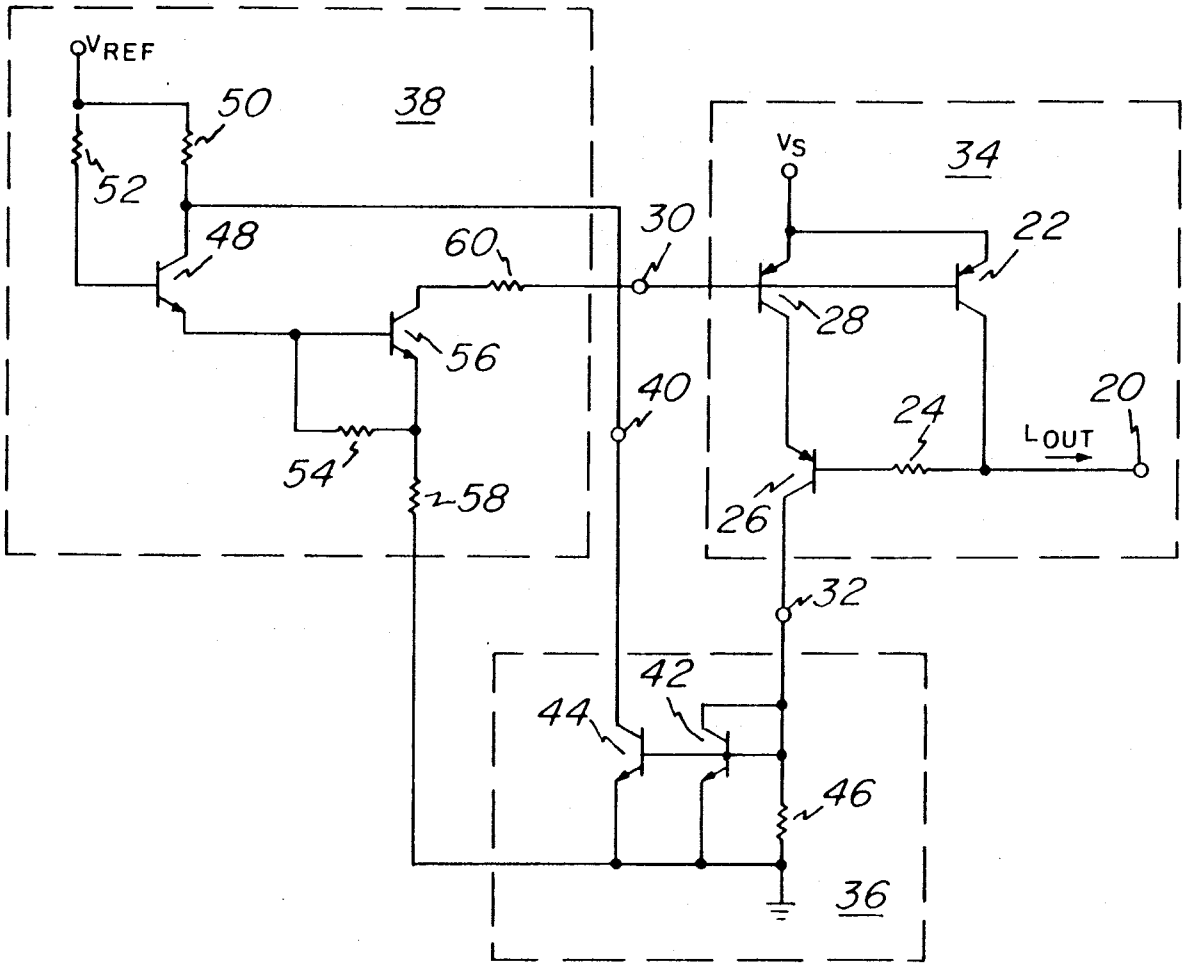
FIG. 4 illustrates a first preferred embodiment of the present invention.

FIG. 4 illustrates a current limiting circuit which embodies the invention. The improved current mirror 34 is coupled to the output node 20, to a node for a limited current source, 30, and to a reference current node 32. A current regulating circuit is coupled to a voltage reference Vref and to the improved current mirror at nodes 30 and 32.

The current regulating circuit is comprised of a current limiting circuit 36 and a current predriving circuit 38. More specifically, current limiter 36 is comprised of transistor 42 which is diode-coupled between reference current node 32 and a common voltage terminal; and transistor 44 which has its base coupled to the base of 42 and couples a current source node 40 to the common voltage terminal through its conductance path. Resistor 46 is coupled between the bases of transistors 42 and 44 and the common voltage.

Current predriving circuit 38 is comprised of transistor 48, transistor 56 and several bias resistors. Transistor 48 is diode coupled to the reference voltage Vref, with its emitter coupled to the base of transistor 56; and having bias resistors 52 and 50. Transistor 56 has bias resistor 54 coupled between its base and emitter, has its emitter coupled to a common voltage through resistor 58, and its collector coupled to the current input node for the current mirror circuit 34 through a current limiting resistor 60.

The limited current node 30 is coupled to the collector of 56 through the resistor 60. The current reference node 40 is coupled to the collector of 48.

In operation, an output is coupled to output node 20. The current regulating circuit is coupled to the invention. The current regulating circuit is comprised of current limiting circuit 36 and a current predrive circuit 38. The sampled current flowing from the collector of transistor 26 is coupled to the current limiter at diode connected transistor 42. The current flowing into 42 will forward bias it and transistor 44 at some point. The current flowing into transistor 44 is taken out of the collector of transistor 48 at current source node 40.

As the current flowing into the current limiting circuit increases in proportion to the current flowing at the output, transistor 48 will enter saturation and the current flowing in its collector will be reduced. This phenomenon will continue as the current flowing from the output node increases, until 48 loses gain and limits the drive to the transistor 56. As 56 sees less voltage and current available at its base, the current flowing in its collector will drop, thus limiting the current available in the collector of 22 and therefore limiting the current available at the output. Resistors 56, 58, and 54 allow the design parameters to be controlled, by choosing appropriate values a person skilled in the art can determine how much current will be allowed to flow out of the output node before limiting occurs.

Resistor 24 provides for proper operation of the circuitry when the output node is at a very low potential or short circuited. Without resistor 24 the collector of transistor 26 will saturate and 26 will not have enough voltage to drive transistors 42 and 44. With resistor 24, the voltage drop from the output node to the collector of 26 will generate sufficient biasing voltage to enable 26 to continue to drive 42 and 44. This prevents the current limiting circuitry from shutting down under low output voltage conditions.

Under conditions when the output node voltage approaches the Vs voltage, 22 will enter saturation and 28 will shut off. This provides better saturation for 22. The output current in this situation is limited by the saturation characteristics of 22.

The operation of the circuit has been described assuming that the transistors 22 and 28 are of identical sizes and have identical beta parameters, similarly transistors 42 and 44. By proportionally sizing the transistors 22 and 28 and similarly transistors 42 and 44, the circuit will function as a current limiter wherein the sampled current is proportional to, but not equal to, the output current. It is the intent of this specification and the claims to cover these and other changes which persons skilled in the art could make without changing the function of the circuitry.

Figure 5:
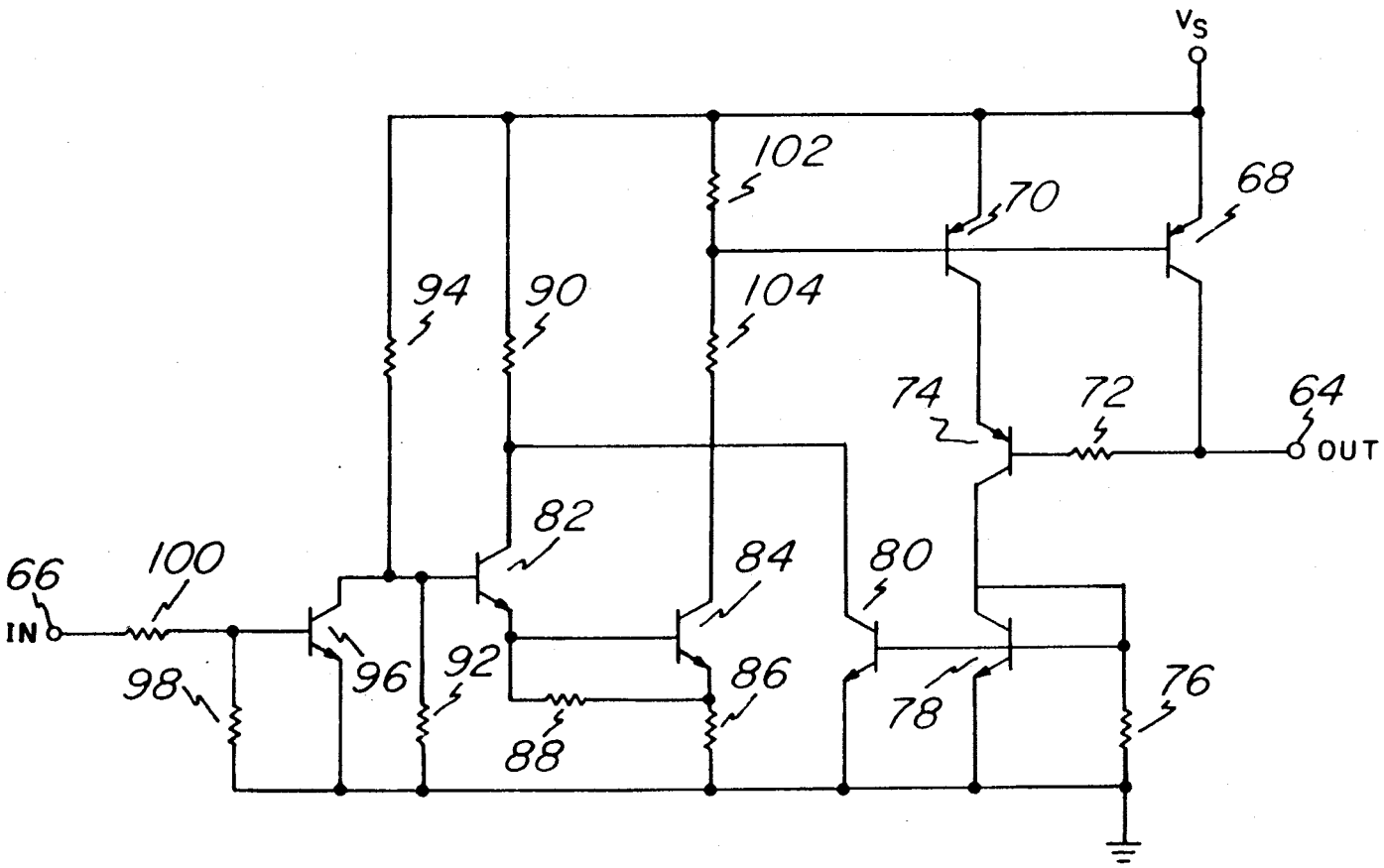
FIG. 5 illustrates an alternative preferred embodiment of the present invention.

FIG. 5 illustrates a second embodiment of a current limiting circuit which incorporates the invention. The output node, 64, is tied to the load circuit, as before. The current mirror circuit, comprised of transistors 68, 70 and 74, and resistor 72, is the invention as described above. Transistors 78, 80 and resistor 76 make up the current limit circuit, while transistors 82, 84 and resistors 86, 88 and 90 make up the current predrive circuit. Transistor 96 and resistors 98 and 100 comprise an input control for setting a threshold voltage. Bias resistors 94 and 92 control the voltage at the base of transistor 82. Resistor 102 is a turn off resistor for transistors 70 and 68.

The operation of the circuit illustrated in FIG. 5 is essentially unchanged from that of the circuit illustrated in FIG. 4. As the output current begins to flow, the sampled current flowing into the current source circuit will forward bias transistors 78 and 80. The current taken into the collector of 80 will reduce the current flowing into the collector of 82. Eventually the current drawn into the collector of 80 in the current source circuitry will starve the base of 84 in the current regulation circuitry, the current flowing into the collector of 84 will drop and the current available at the collector of 68 will drop, thus limiting the current available at the output.

Current control can be achieved by choosing the sizes and beta parameters of the various transistors so as to limit the output current to the desired level. Resistor 86 sets the maximum drive available to transistors 68 and 70. Resistor 104 controls the current at the output by limiting the base currents of transistors 68 and 70. The inherent resistance of the collector of transistor 68 will control the current flowing into the circuit when transistor 68 enters saturation.

Resistors 100 and 98 set the input threshold voltage. These resistors, along with transistor 96, control the voltage at the base of transistor 82, which can be used to regulate the output voltage.

As in the embodiment of FIG. 4, appropriate transistor sizing can be used to create a sampled current which is proportional to the output current.

While this invention has been described with reference to the illustrative embodiments, this description is not intended to be construed in a limiting sense. Various modifications and combinations of the illustrative embodiments, as well as other embodiments of the invention, will be apparent to persons skilled in the art upon reference to the description. It is therefore intended that the appended claims encompass any such modifications or embodiments.

I claim:

1. A method for sensing current supplied to an output load device, comprising the steps of:

providing an output current from a circuit output terminal that is coupled to a current drive transistor;

providing a current mirror transistor coupled to said current drive transistor for generating a sampled current output from the current drive circuit that is proportional to the amount of current supplied to the circuit output load terminal;

providing a voltage sensing transistor having its base coupled to said output load terminal and being further coupled to the conduction path of the current mirror transistor;

sensing the voltage level to the output load device with said voltage sensing transistor coupled to the said circuit output terminal so that the voltage drop across said current sensing transistor is kept approximately equal to the voltage drop across said current drive transistor; and correcting the sampled current output such that the sampled current value is proportional to the current at the circuit output terminal over the range of voltage values at said circuit output terminal.

2. The method for sensing current of claim 1, and further comprising:

coupling the sampled current signal to a feedback regulator which limits the current available to the driving transistor coupled to the circuit output terminal when the sampled current at said output terminal exceeds a predetermined threshold.

* * * * *